US005479659A

United States Patent [19]

Bachner, Jr.

[11] Patent Number: 5,479,659

[45] Date of Patent: Jan. 2, 1996

[54] LIGHTWEIGHT BALLISTIC RESISTANT GARMENTS AND METHOD TO PRODUCE THE SAME

[75] Inventor: Thomas E. Bachner, Jr., Unionville, Pa.

[73] Assignee: Second Chance Body Armor, Inc., Central Lake, Mich.

[21] Appl. No.: 137,596

[22] Filed: Oct. 15, 1993

[51] Int. Cl.[6] ..... A41H 1/02

[52] U.S. Cl. ..... 2/2.5

[58] Field of Search ..... 2/2.5, 2, 44, 92, 2/102; 428/911, 102, 224; 89/36.02, 36.05; 112/440, 441

[56] References Cited

U.S. PATENT DOCUMENTS

| | | | |
|---|---|---|---|
| 4,522,871 | 6/1985 | Armellino, Jr. et al. | 2/2.5 X |
| 4,608,717 | 9/1986 | Dunbavand | 2/2.5 |
| 4,989,266 | 2/1991 | Borgese et al. | 2/2.5 |
| 5,327,811 | 7/1994 | Price et al. | 2/2.5 X |

*Primary Examiner*—Paul C. Lewis
*Attorney, Agent, or Firm*—Potthast & Ring

[57] ABSTRACT

A ballistic resistant garment (10) for covering and protecting vital portions of a human body having at least two panels (28, 30) which are adjacent and overlie one another in which each panel comprises at least two layers of ballistic resistant material (34, 36) in which the ballistic material (34, 36) is woven (52) and a plurality of stitches (42) which are disposed into a first panel (28) of the at least two panels (28, 30) connecting the at least two layers of ballistic resistant material (34, 36) within the first panel (28) in which the plurality of stitches (42) are positioned in a row (54) in a first direction and another plurality of stitches (74) which are disposed into a second panel (30) of the at least two panels (28, 30) connecting the at least two layers of ballistic resistant material (34,36) within the second panel (30) in which the another plurality of stitches (74) are positioned in at least two rows (44, 62), in which the at least two rows (44, 62) are in a second and third direction (44, 62) respectively in which the second and third directions(44, 62) are transverse to one another and in which the row (54) in the first direction (54) of the first panel (28) is transverse to the two rows (44, 62) in the second and third direction (44, 62) of the second panel (30) in which the plurality and another plurality of stitches (42, 74) are positioned away from the periphery (48) of the first and second panels (28,30).

84 Claims, 4 Drawing Sheets

LIGHTWEIGHT BALLISTIC RESISTANT GARMENTS AND METHOD TO PRODUCE THE SAME

BACKGROUND OF THE INVENTION

1. Field of the Invention

The present invention relates to ballistic resistant garments and method to use the same, and more particularly, to ballistic resistant garments having multiple layers of ballistic resistant material being stitched together.

2. Description of the related art including information disclosed under 37 CFR 1.97–1.99

In the past, protective armor, both solid and jointed so as to be flexible, has been used for personal protection against missiles such as knives, spears, arrows, and the like. Such personal protective armor was substantially discarded with the advent of firearms, since the prior structures, when sufficiently heavy to protect against a bullet or the like, were too heavy and/or unwieldy to wear.

In the recent past, with the development of ballistic cloth, protective garments against ballistic resistant missiles such as bullets, shot, shell fragments, trauma and cutting instruments, hereinafter referred to as ballistic missiles, has gained favor with law enforcement officials, soldiers, dignitaries subject to assassination, and the like.

While these known ballistic cloths or materials are well recognized by many as industry standard materials, they have generally suffered from an inability to protect the wearer from certain threats and have been somewhat particularly heavy and unwieldy and therefore less desirable to wear as well as hard to conceal.

It is known to have ballistic resistant garments having at least two panels with layers of ballistic resistant material in each panel with the layers of each panel stitched together at the periphery of the layers of the ballistic resistant material. However, these known garments do not have much stitching away from the periphery and through the central portion of the panel. Thus ballistic resistant garments are no longer in favor because the peripheral stitching reduces flexibility and the two such panels are ballistically less sufficient then one. In addition, the provision of separate panels afford the user with the potentially dangerous option of wearing one half of the prescribed amount of protection.

U.S. Pat. No. 4,079,464 issued Mar. 21, 1978 to Roggin, discloses a protective garment with only one panel composed on many layers of ballistic resistant material with stitching across the central portion of the panel. However, this garment requires many layers of ballistic resistant material to effectively resist a bullet. Disadvantageously, this known garment having a panel composed of many layers of ballistic resistant material is heavy to wear, stiff, unwieldy, cumbersome to move in, and hard to conceal.

It is also known in the prior art of the development of ballistic resistant aramid fibre fabric such as "Kevlar" (a registered trademark) of DuPont Company, of Wilmington, Del. In 1988, DuPont commercialized a significantly stronger, lighter, more flexible and wearable second generation family of aramid fibers "Kevlar" (a registered trademark) 129. "Kevlar" (a registered trademark) 129, style 704, had a 840 denier with 560 filaments with a balanced palin weave of 31 fibers per inch for the warp by 31 ends per inch for the fill. This is in a balanced plain weave with 17,360 filaments per inch in each direction and with 301,369,600 cross overs per square inch. The general prevailing opinion in the prior art concerning the effectiveness of ballistic resistant fabric is that the higher the number of fiber and filament crossover points, the quicker the energy of an impacting bullet is transferred through the layers of fabric and the less chance of the bullet penetrating the wearer's body. However, in order to maintain a higher number of fiber and filament cross overs in a fabric the fabric is less flexible and therefore less moldable to the wearer's body. This also correlates to having heavier layers of ballistic resistant fabric because a higher number of warp by fill fibers are needed in the weave in order to have adequate cross over numbers for protection from a bullet. Thus, a heavier, more cumbersome, and harder to conceal garment is produced and therefore it becomes less desirable for those who need ballistic protection to put on such a garment.

It is also known in the prior art of ballistic resistant garments that have two panels of ballistic resistant material, such as Hyper-Lite (a registered trademark) for a ballistic resistant garment series made by Safariland Body Armor, Inc. However, only one panel of this garment is composed of a flexible lightweight woven material and the other panel is composed of reinforced plastic hybrid, "Spectrashield" (a registered trademark) of Allied Signal for reinforced plastic which has two layers of fibers bonded with a resin at 0 degrees to 90 degrees orientation and the fibers and resin are packaged between upper and lower polyethylene film layers in which the fabric fibers are not woven but are maintained in tension by the resinous packaging material, which is less flexible than a panel composed of only woven material. Thus, a cumbersome, and harder to conceal garment is produced and therefore it becomes less desirable for those who need ballistic protection to put on such a garment.

It is also known in the prior art if a ballistic resistant garment that have three panels of ballistic resistant material where the outer panels composed of a woven material, made of "Kevlar" (a registered trademark) for an aramid fibre and the inner panel composed of a nonwoven semi-rigid plastic such as Spectrashield (a registered trademark) and which makes this garment less flexible. Thus, a cumbersome, and harder to conceal garment is produced and therefore it becomes less desirable for those who need ballistic protection to put on such a garment.

It is also generally known that the combination of various ballistic fabrics with reinforced plastics such as Allied Signal's "Spectrashield" (a registered trademark), can produce garments that pass lab test standards for ballistic resistant garments. However, these garments are generally stiffer and/or thicker and less comfortable to wear. Additionally, it has not yet been demonstrated that some of these materials will stop bullets when used on the human body.

SUMMARY OF THE INVENTION

It is therefore the principal object of the present invention to provide a ballistic resistant garment, for covering and protecting vital portions of a human body, having at least two panels which are adjacent and overlie one another in which each panel has at least two layers of ballistic resistant material in which said ballistic resistant material is woven, and a plurality of stitches which are disposed into at least one panel connecting the at least two layers of ballistic resistant material within the at least one panel together and in which the stitches are positioned away from the periphery of said at least one panel.

It is a further object of this invention to provide a ballistic resistant garment, for covering and protecting vital portions of a human body, having at least two panels which overlie one another in which each panel has at least two layers of ballistic resistant material, and a plurality of stitches which are disposed into a panel of said at least two panels connecting said at least two layers of ballistic resistant material together within said panel in which said plurality of stitches are positioned away from the periphery of said panel and another plurality of stitches are disposed into another panel of said at least two panels connecting said at least two layers of ballistic resistant material together within said another panel in which said another plurality of stitches are positioned away from the periphery of said another panel.

Another object of the invention is to provide a method for constructing a ballistic resistant garment, for covering and protecting vital portions of a human body having the steps of assembling at least two panels each having at least two layers of ballistic resistant material in which said ballistic material is woven and stitching a plurality of stitches into at least one panel connecting said at least two layers of ballistic resistant material within said at least one panel together and in which said plurality of stitches are positioned away from the periphery of said at least one panel; and placing at least two of said at least two panels adjacent and overlying each other.

A further object of this invention is to provide a method for constructing a ballistic resistant garment, for covering and protecting vital portions of a human body, having the steps of assembling at least two panels each having at least two layers of ballistic resistant material and stitching a plurality of stitches first into a panel connecting said at least two layers of ballistic resistant material within said panel together and secondly into another panel connecting said at least two layers of ballistic resistant material within said another panel in which said plurality of stitches in each panel are positioned away from the periphery of each respective panel.

It is a further object of this invention to provide a ballistic resistant garment that has at least two panels with layers of ballistic resistant material in each panel with the panels having a plurality of stitches away from the periphery of each of the panels or across the central portion of each of the panels in which the stitches are made of a high tensile strength material in order for the stitching to help transmit energy throughout the panel upon impact of a bullet on the panel. The separately stitched panels work synergistically to transmit energy laterally away from the impact which reduces the depth of the penetration of the bullet and provides a broader and shallower indentation into the panel. This action thereby reduces or dampens undesirable distortion of the panel in the impact area maintaining the ballistic resistant capabilities of the panel in proximity to that impact area higher in case of a subsequent impact of another bullet in that area. Further, as was evidenced by the commonly used voluntary ballistic standard test given by the National Institute of Justice Standard 0101.03, this transmission of energy through the panel will help flatten areas of the panel that were previously impacted by a bullet and thereby help maintain higher ballistic resistant capabilities of the panel in that previously impacted area. Further, such stitching that will transmit energy from bullet impact will permit constructing lighter, thinner, more flexible, more concealable and wearable and, therefore higher performance ballistic resistant garments.

It is a further object of this invention to provide a desirable ballistic resistant garment that utilizes a novel new fabric that has filament crossover points between 100,000,000 to 275,000,000 filament crossovers per square inch with the fabric having significantly lower warp by fill fiber counts. Thus, this invention provides a wearer with a garment having a desired performance with lighter weight, thinner dimensions, more flexibility, more concealability and therefore a garment that is more likely to be worn when needed.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENTS

Figure 1:
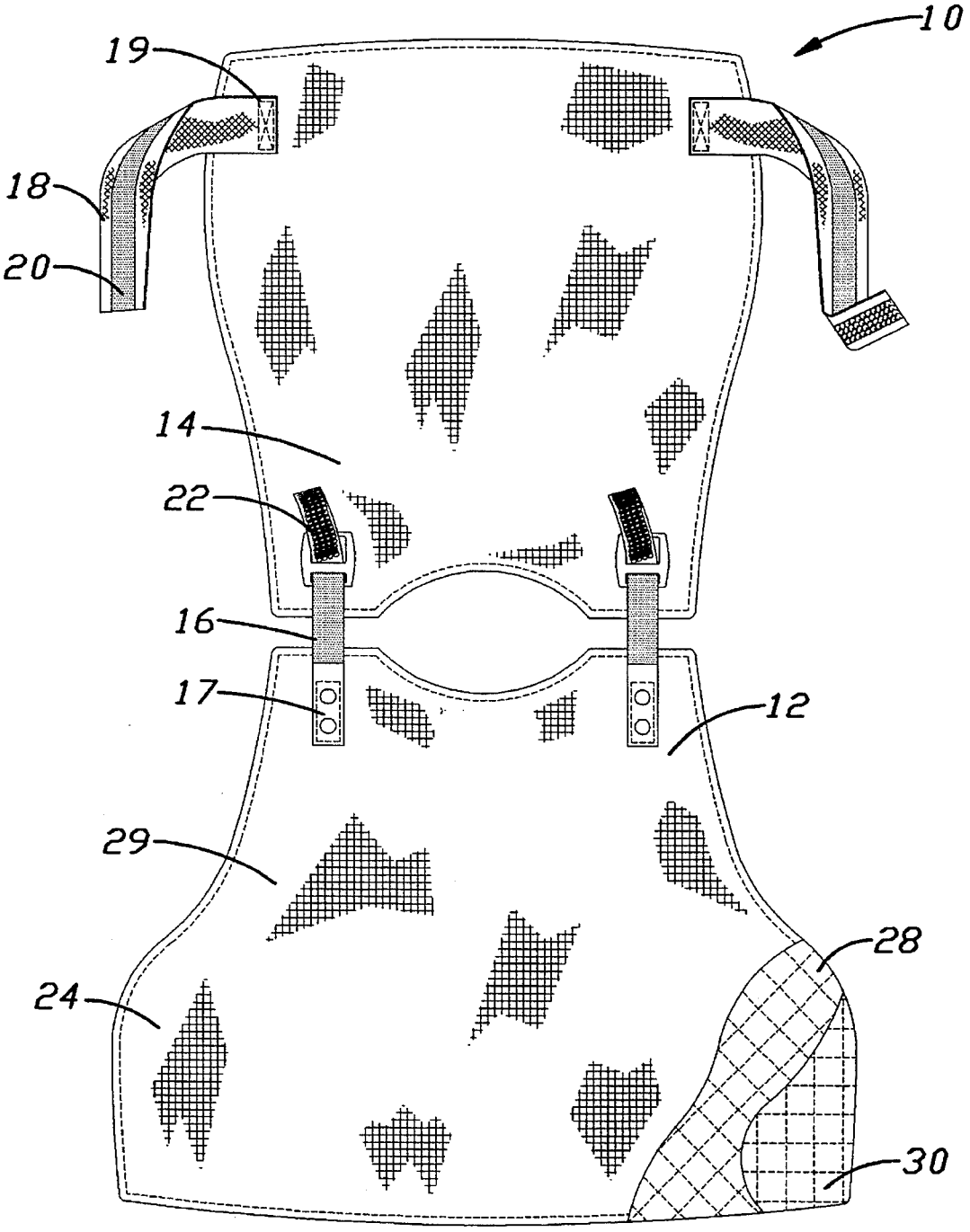
FIG. 1 is a plan view of the preferred embodiment in which a portion is broken away revealing at least two panels.

Referring now to the drawings, ballistic resistant garment 10 illustrated in FIG. 1 includes front panel 12 and back panel 14 connected together at the shoulder area by shoulder straps 16 having one portion 22 of Velcro connecting structure, or other like connecting structure known in the art, secured to free ends 17 thereof and the other ends of straps 16 are secured to front panel 12. In use, front panel 12 and back panel 14 are secured together at the sides of the middle torso of a person wearing ballistic resistant garment 10 by straps 18 having one portion 20 of Velcro connecting structure secured to the free ends thereof. The other ends 19 of straps 18 are secured to back panel 14.

Front panel 12 of ballistic resistant garment 10, as shown in FIGS. 1, 2A 2B, and 3, includes at least two panels 28, 30, which are adjacent and overlie one another in which each panel 28, 30 is composed of at least two layers of ballistic resistant material 34, 36 which ballistic resistant material 34, 36 is woven material 52. The term adjacent means at least a portion of panel 28 is in contact or touching at least a portion of panel 30. Back panel 14 of ballistic garment 10 as shown in FIGS. 1 and 2D, includes at least two panels 28, 30 which are adjacent and overlie one another in which each panel 28, 30 is composed of at least two layers of ballistic resistant material 34, 36 which ballistic resistant material 34, 36 is woven material 52.

Figure 2A:
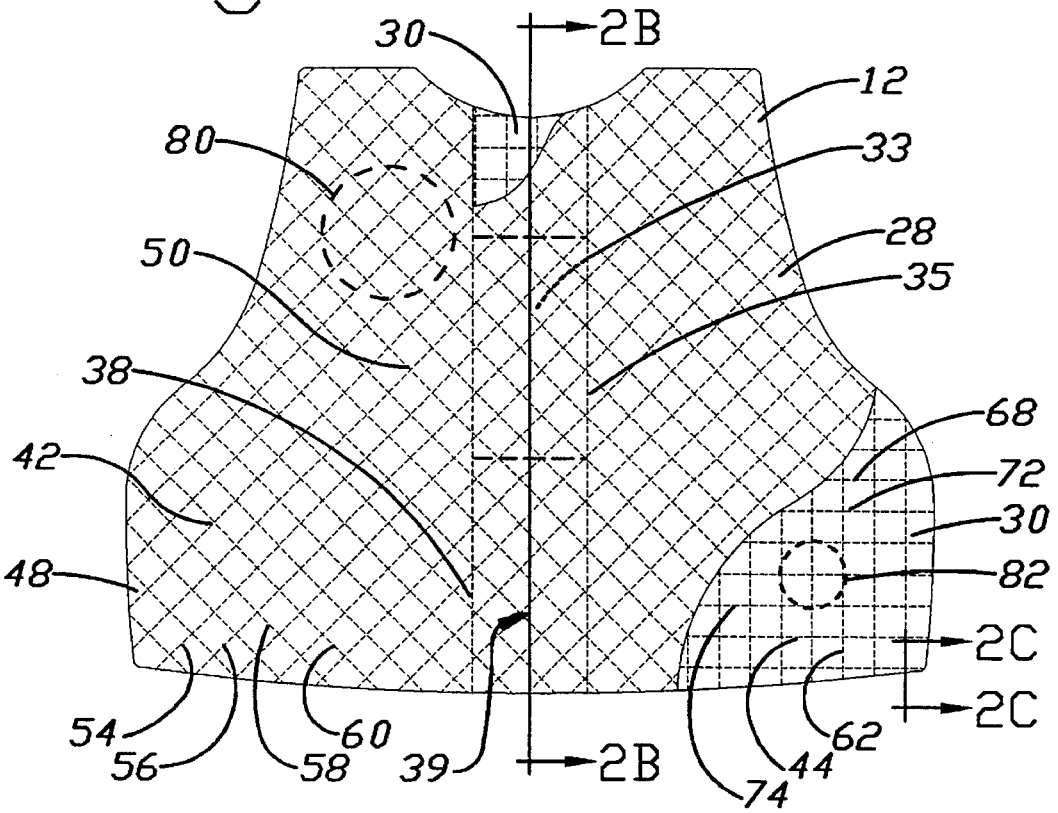
FIG. 2A is a partial broken away view of a plan view of the at least two panels of a front portion of the ballistic resistant garment.
Figure 2B:
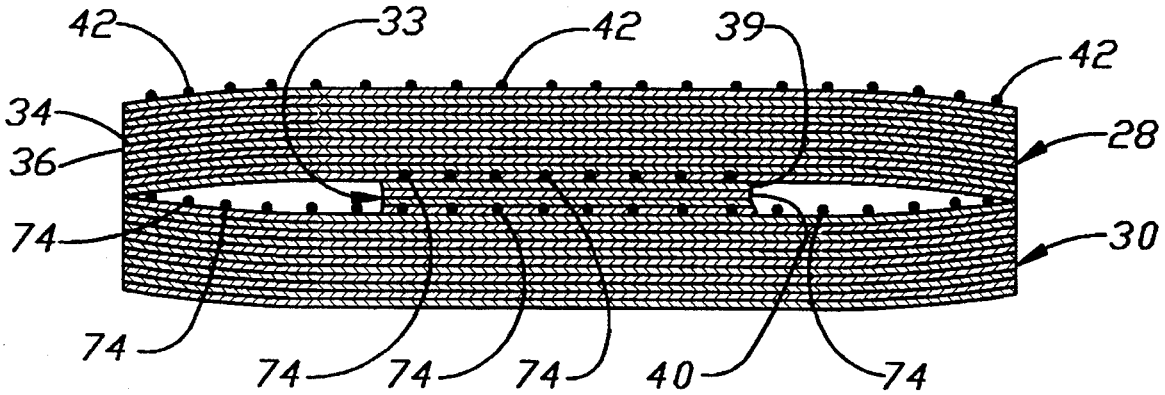
FIG. 2B is a cross section of FIG. 2A along line 2B—2B.

Referring to FIGS. 1, 2A and 2B, at least two panels 28, 30 are enclosed within a sleeve member 24 made of fabric material known and well accepted in the industry such as Nylon, Polyster, woven or rip stop paffeta, mesh net, pricot net, or any other suitable material known in the art. Sleeve member 24 is also able to be composed of any waterproof material commonly known in the art because it has been determined that nonwater repellant materials tend to lose a portion of their ballistic resistant property when becoming wet greater than fifteen percent (15%) water by weight.

Sleeve member 24 is also able to be composed of any nonwater resistant material known in the art because nonwater resistant material allows the wearer of ballistic resistant garment 10 body to breath more effectively than nonwaterproof material. Thus, many people opt to wear nonwater resistant sleeve member 24.

Sleeve member 24 is sewn together at periphery of sleeve member 24 by stitching around at least two panels 28, 30 whereby the stitching does not impair at least two panels 28, 30 or at least two layers of ballistic resistant materials 34, 36 enclosed within sleeve member 24. Sleeve member 24 can also be secured along the inner portion of sleeve member 24 or any where on sleeve member 24 that is suitable to prevent the outside environment from penetrating sleeve member 24. Other ways of securing sleeve member 24 that are known in the art are also utilized to secure sleeve member 24 and to prevent other outside elements from coming into contact with at least two layers of ballistic resistant material 34, 36.

Referring to FIG. 1, at least two panels 28, 30 are connected together with a means for securing 29 at least two panels 28, 30 together. This securing means includes putting at least two panels 28, 30 into sleeve member 24. Sleeve member 24 can then be secured together by any of the various means mentioned in the above paragraph, such as through internal stitching that does not impair at least two layers of ballistic resistant material 34, 36 or the at least two panels 28, 30 or peripheral stitching of sleeve member 24 that does not impair at least two layers of ballistic resistant material 34, 36 or the at least two panels 28, 30 or any other ways known in the art.

Referring to FIG. 2B, securing means 29 for connecting at least two panels 28, 30 together also includes a multiplicity of stitches 35. Multiplicity of stitches 35 connect at least one panel 28 with at least one panel 30. Multiplicity of stitches 35 are composed of a high tensile strength material of any aromatic polyamide such as an aramid or "Kevlar" (a registered trademark) or any other similar material known in the prior art. Multiplicity of stitches 35 are also able to be composed of any suitable material known in the art, other than the claimed high tensile strength material.

Securing means 29 for connecting at least two panels 28, 30 together also is through any suitable securing means known in the art such as "Velcro" (a registered trademark) for multiple mating hook and loop fasteners.

Referring to FIGS. 2A, 2B and 2D, ballistic resistant garment 10 includes soft core panel 36 disposed between at least two panels 28, 30. Soft core panel 36 is secured to at least one of said two panels 28. This securement is by the use of further plurality of stitches 38 to at least one of at least two panels 28, or by any other similar securement means known in the art, such as Velcro (a registered trademark). Further plurality of stitches 38 are composed of a high tensile strength material of any aromatic polyamide such as an aramid or "Kevlar" (a registered trademark); or any other similar material known in the prior art.

Still referring to FIGS. 2A and 2B, soft core panel 33 has dimensions less than dimensions of said at least two panels 28, 30. Soft core panel 36 is positioned to overlie a sternum area 39 of a wearer of ballistic resistant garment 10 and is also positioned to overlie a spinal cord area 41 of a wearer of ballistic resistant garment 10.

Referring to FIG. 2B, soft core panel 33 includes at least two sheets of ballistic resistant material 39, 40. At least two sheets of ballistic resistant material 39, 40 help protect the vital portions of the wearer's body. However, this embodiment does not need soft core panel 36 to be effective. Soft core panel 33 is just an added precaution to the preferred embodiment of this invention.

Still referring to FIG. 2B, At least two sheets of ballistic resistant material 39, 40 are composed of high tensile strength material made of any aromatic polyamide such as an aramid or Kevlar®, or any other similar material known in the art.

Figure 2C:
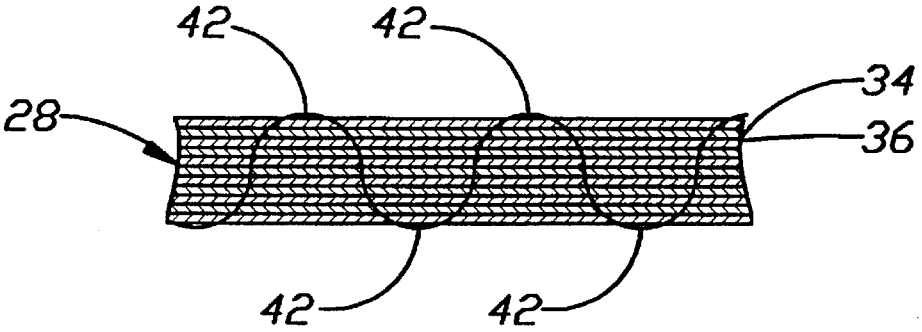
FIG. 2C is a cross section of FIG. 2A along line 2C—2C.
Figure 2D:
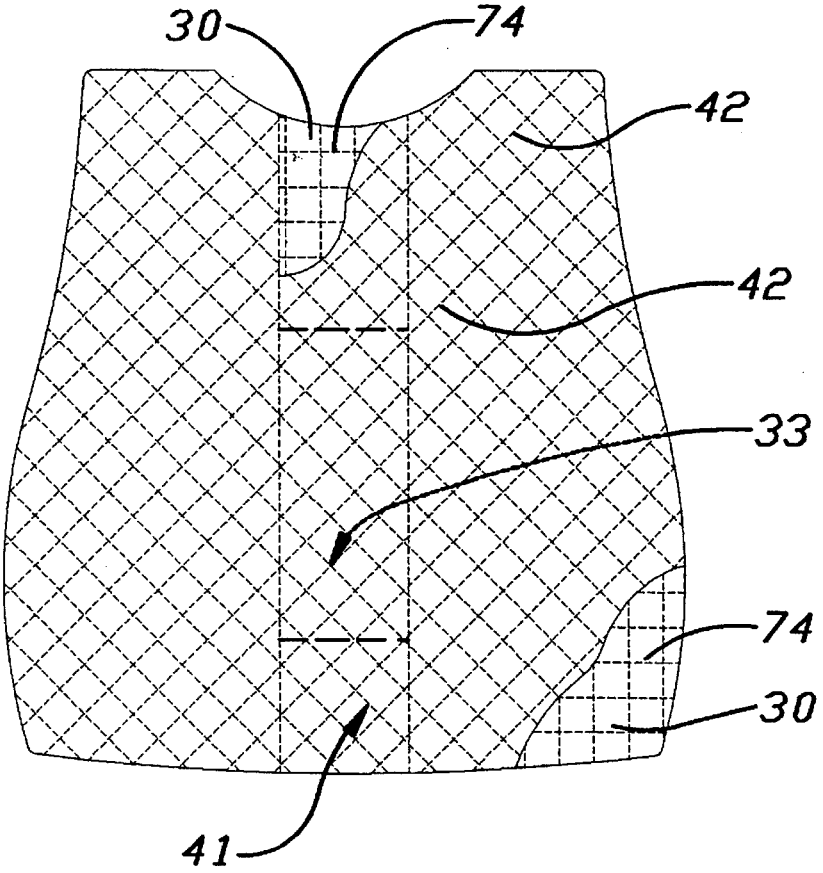
FIG. 2D is a partial broken away view of a plan view of the at least two panels of a back portion of the ballistic resistant garment.

Referring to FIGS. 2A and 2C, ballistic resistant garment 10 has a plurality of stitches 42 which are disposed into at least one panel 28 connecting at least two layers of ballistic resistant material 34, 36 within at least one panel 28 together and in which plurality of stitches 42 are positioned away from the periphery 48 of at least one panel 28. The periphery is the outermost part or region within a precise boundary so plurality of stitches 42 are positioned away from the outermost boundary 48 of at least one panel 28 and are directed toward center portion 50 of at least one panel 28.

Still referring to FIGS. 2B and 2C, at least two layers of ballistic resistant material 34, 36 of one of said at least two panels 28 are composed of the same material. At least two layers of ballistic resistant material 34, 36 of all of said at least two panels 28, 30 are also composed of the same material. The material for at least two layers of ballistic resistant material 34, 36 is composed of a high tensile strength material made up of any aromatic polyamide such as aramid or "Kevlar" (a registered trademark), or any like suitable material known in the prior art.

Still referring to FIGS. 2B and 2C, each layer of at least two layers of ballistic resistant material 34, 36 of one of at least two panels 28 are substantially the same shape or substantially the same length and width dimensions or are substantially of the same thickness. Each of said two panel 28, 30 have substantially equal number of at least two layers of ballistic resistant material 34, 36. Each of said two panels 28, 30 have substantially equal thickness.

Figure 3:
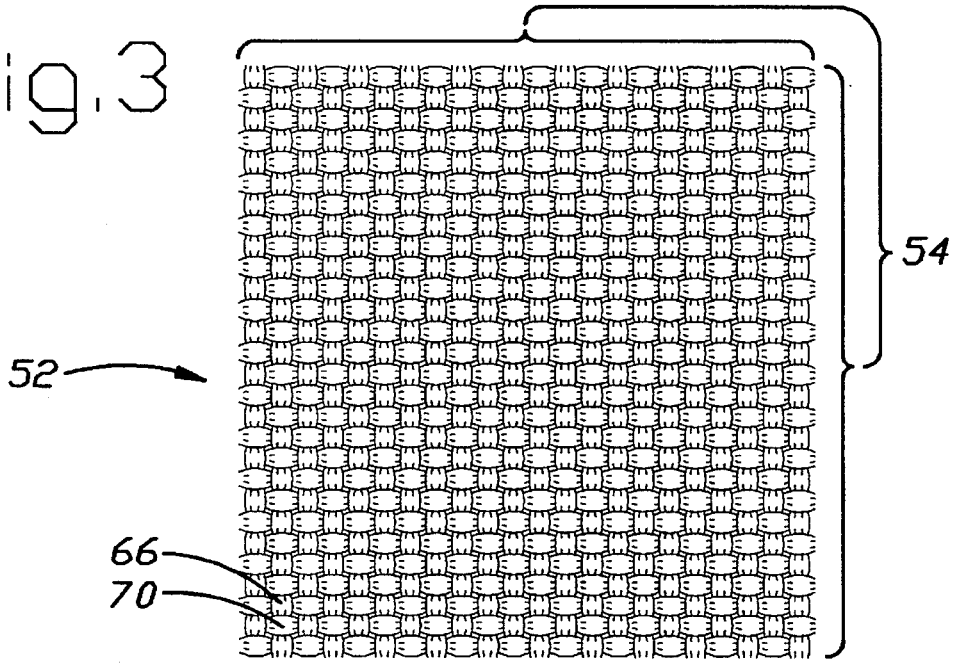
FIG. 3 is an enlarged plan view of a balanced weave of the fabric of a ballistic resistant material.
Figure 4:
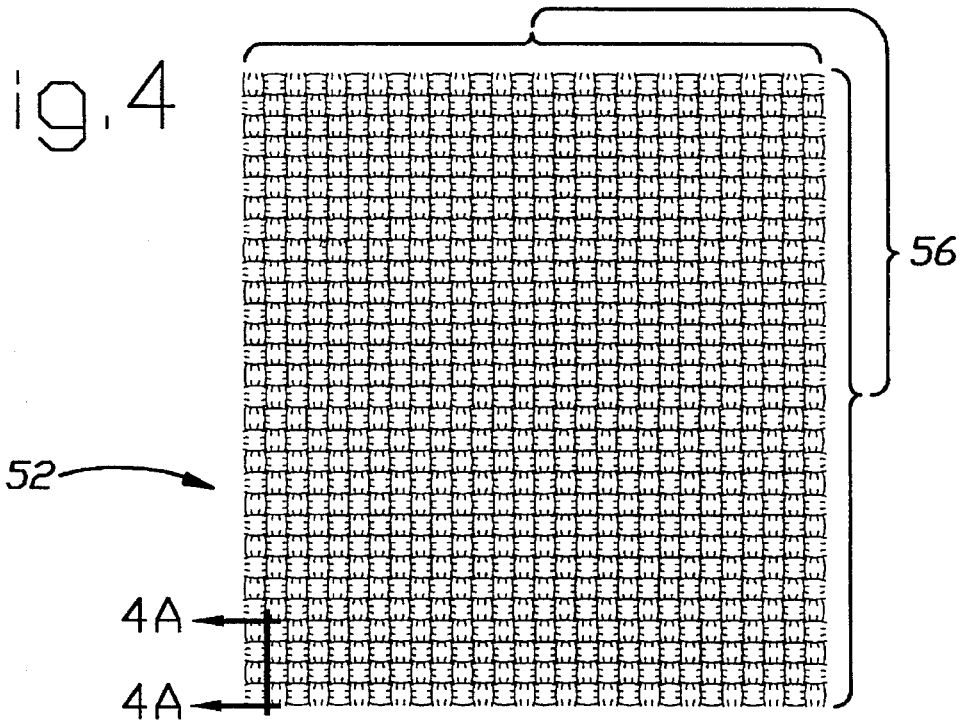
FIG. 4 is an enlarged plan view of an imbalanced weave of the fabric of a ballistic resistant material.
Figure 4A:
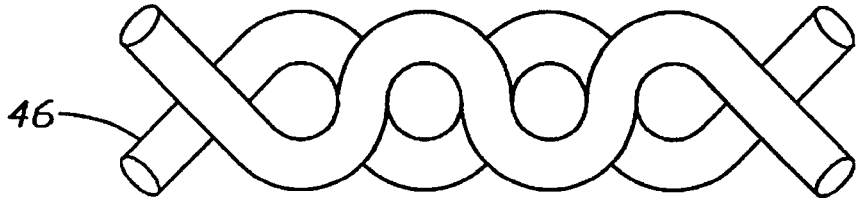
FIG. 4A is an enlarged view of a cross section of FIG. 4 at 4A—4A.

Referring now to FIGS. 3, 4 and 4A, at least two layers of ballistic resistant material 34, 36 is of woven material 52. Woven material 52 is composed of fibers 46 with a denier in a range from 50 to 3000. A denier is a unit of measurement of g/9000 meters. Woven material 52 is also composed of fibers 46 that must have a number of filaments in a range from 25 to 5000. Woven material 52 is also composed of fibers 46 in a warp to fill weave ratio in a range of 10 by 10 to 75 by 75. Woven material 52 is also composed of fibers 46 with filament cross-overs per square inch in the range of 200,000 to 1,000,000.

Woven material 52 is in a balanced weave 54, which means that there is an equal number of fibers of woven material 52 length and width. Woven material 52 may also be in an unbalanced weave 56, which means that there are an unequal number fibers of woven material 52 on the length versus the width of the woven material 52.

An example of woven material 52 that is particularly effective and efficient in resisting bullets while still maintaining a light, thin, flexible, concealable and more wearable ballistic resistant garment is woven material 52 with high tensile fibers having a denier of 840 and a range of filaments of 560 to 667 and an imbalanced weave with the weave having a warp to fill ratio of only 24 by 22 and having filament cross-overs per square inch in a range of 100,000,000 to 275,000,000. The high tensile fibers have only a weave ratio of 24 by 22 which is thin by normal standards in the art, yet it successfully resists penetration from a bullet. Additionally, the high tensile material 52 has filament cross-overs per square inch in a range of only 100,000,000 to 275,000,000 which is considered low in the prior art. The reason this embodiment is so effective is the combination of a thinner more wearable weave which is unbalanced with a lower number of filament cross-over points which is contrary to the art. The lower filament cross-over points allows the fibers room to absorb and dispense the energy from the bullet laterally so that the bullet does not penetrate as deeply as it does with higher filament cross-over points which have a tendency to be less flexible and not as conducive to this tranferance of energy. Thus, this embodiment achieves efficient penetration resistance with less weight of ballistic resistant material.

Referring to FIG. 2C, plurality of stitches 42 which are disposed into at least one panel 28 connecting at least two layers of ballistic resistant material 34, 36 within at least one panel 28 together are composed of a high tensile strength material made of any aromatic polyamide such as aramid and Kevlar®, or any other like material known in the art.

Plurality of stitches 42 composed of a high tensile strength material such as Kevlar® transmits energy throughout the at least one panel 28 through the high strength tensile material 52 when a bullet impacts with at least one panel 28 to reduce the depth of the penetration of the bullet and also helps flatten areas of at least one panel 28 that were previously impacted by a bullet and thereby help maintain higher ballistic resistant capabilities of at least one panel 28 in that previously impacted area to help alleviate a bullet from penetrating the wearer's body.

Referring to FIGS. 2A and 2B, plurality of stitches 42 which are disposed into at least one panel 28 connecting at least two layers of ballistic resistant material 34, 36 within at least one panel 28 are aligned in at least one row of stitches 54. Plurality of stitches 42 are also able to be in at least two rows of stitches 54, 56, where one row of stitches 54 is substantially parallel to row of stitches 56. Plurality of stitches 42 are also able to be in a multiplicity of rows of stitches 54, 56 which are transverse to a multiplicity of at least one row of stitches 58 and rows stitches 54, 56, 58 are positioned over a substantial portion of at least one panel 28.

Plurality of stitches 42 are also able to be in at least two rows of stitches 54, 58 whereby row of stitches 58 is positioned transverse to row of stitches 54. Plurality of stitches 42 are also able to be in at least one row of stitches 54 substantially perpendicular to at least one row of stitches 58. Plurality of stitches 42 are also able to be in multiples rows of stitches 54, 56 substantially perpendicular to multiple rows of stitches 58, 60 positioned over a substantial portion of at least one panel 28. Multiple rows of stitches 54, 56 are spaced apart from one another and multiple rows 58, 60 are spaced apart from each other.

Plurality of stitches 42 are also able to be in one row of stitches 44 positioned transverse to another row of stitches 62 in which at least two layers of ballistic material 34, 36 is a woven material 52 and in which at least one row of stitches 44 is substantially parallel to the warp 66 of woven material 52. Warp 66 of woven material 52 is the fibers 46 running longitudinally within the fabric material 52. Plurality of stitches 42 also have one row of stitches 68 in which at least two layers of ballistic material 34, 36 is a woven material 52 with fill 70 and at least one of another row of stitches 72 is substantially parallel to fill 70. Fill 70 of a woven material 52 are the fibers 46 in transverse direction to warp 66. Plurality of stitches 42 in which at least two layers of ballistic resistant material 34, 36 is a woven material 52 in which at least one row of stitches 72 is transverse to warp 66 of woven material 74. Plurality of stitches 52 in which at least one row of stitches 68 is substantially perpendicular to warp 66 and where at least one of another row of stitches 62 is transverse to fill 70 of woven material 52 and in which another row of stitches 44 is substantially perpendicular to fill 70.

Ballistic resistant garment 10 in which at least one panel 28 has a multiplicity of rows of stitching 54, 56 spaced apart from one another and aligned substantially in one direction and has a multiplicity of another rows of stitching spaced from one another 58, 60 in which another rows are transverse to rows of stitching 54, 56 and in which the other of at least two panels 30 has a multiplicity of rows of stitching 44, 62 spaced apart from one another and aligned substantially in a first direction and a multiplicity of another rows of stitching 68, 72 spaced apart and aligned substantially in a second direction transverse to said first direction and in which said multiplicity of rows of stitching of said one of said panels 54, 56 is transverse to at least one of said multiplicity of rows of stitching 44, 62 to the other of at least two panels 30.

Plurality of stitches 24 composed of high tensile material allows the energy from a bullet to spread transversely throughout at least one panel 28 which reduces the depth of the penetration of the bullet. Additionally, the energy that spreads transversely from the plurality of stitches 24 upon impact with a bullet actually reduces the ballistic resistant garment from bunching together after impact of a bullet and as the energy transverses throughout the panel, it flattens the ballistic resistant garment after impact of a bullet to help alleviate a second bullet from penetrating the wearer's body. Additionally, plurality of stitches 24 permits more flexibility and thus more wearability.

When an embodiment combines the high strength tensile material 52 with high tensile threads, ballistic resistant garment 10 becomes even more efficient in resisting ballistic missiles and the like while still maintaining the lightweight and flexibility of high strength tensile material because the high strength tensile material spreads the energy transversely which reduces the depth of the penetration of the bullet while at the same time, energy from the bullet spreads transversely along the high strength threads and upon impact with a bullet actually reduces the ballistic resistant garment from bunching together after impact of a bullet and as the energy transverses throughout the panel, it flattens the ballistic resistant garment after impact of a bullet to help alleviate a second bullet from penetrating the wearer's body.

Referring to FIGS. 2A and 2B, ballistic resistant garment 10 for covering and protecting vital portions of a human body has at least two panels 28, 30 which overlie one another in which each panel has at least two layers of ballistic resistant material 34, 36 and a plurality of stitches 42 which are disposed into a panel 28 of said at least two panels 28, 30 connecting said at least two layers of ballistic resistant material 34, 36 together within said panel 28 in which said plurality of stitches 42 are positioned away from the periphery of said panel 28 and another plurality of stitches 42 are disposed into another panel 30 of said at least two panels 28, 30 connecting said at least two layers of ballistic resistant material 34, 36 together within said another panel 30 in which said another plurality of stitches 74 are positioned away from the periphery of said another panel 30.

Referring to FIG. 2A, ballistic resistant garment 10 in which said plurality of stitches 42 and another plurality of stitches 74 are each oriented in at least one row in each of the respective panels 28, 30. At least one of at least said plurality of stitches 42 and another plurality of stitches 74 includes another at least one row of stitches 54 transverse to said at least one row of stitches 44.

Still referring to FIG. 2A, ballistic resistant garment of claim 10 in which said panel 28 and said another panel 30 each have a plurality 42 and another plurality of stitches 74 respectively in which said plurality of stitches 42 includes a multiplicity of rows 54, 56 spaced apart and substantially parallel to one another and a multiplicity of another rows of stitches 58, 60 spaced apart from one another and substantially parallel to one another in said panel 28 in which said multiplicity of rows 54, 56 and said another rows 58, 60 are transverse to one another and in which said another plurality of stitches 74 of said another panel 30 includes a multiplicity of rows of stitches 44, 62 spaced apart from one another and substantially parallel to one another and another multiplicity of rows of stitches 68, 72 spaced apart from one another and substantially parallel to one another in which said multiplicity of rows of stitches 44, 62 and said another multiplicity of rows stitches 68, 72 of said another panel 30 are transverse to one another. The transverse is substantially perpendicular.

Still referring to FIG. 2A, ballistic resistant garment 10 in which said multiplicity of rows of stitches 54, 56 and another multiplicity of rows of stitches 58, 60 of said panel each extend substantially across said panel 28 and in which said multiplicity of rows 44, 62 and said another multiplicity of rows of stitches 68, 72 of said another panel each extend substantially across said another panel 30.

Still referring to FIG. 2A ballistic resistant garment 10 in which at least one of said multiplicity of rows of stitches 54, 56 and another multiplicity of rows of stitches 58, 60 of said panel 28 are transverse to at least one of said multiplicity of rows of stitches 44, 62 and another multiplicity of rows of stitches 68, 72 of said another panel 30.

Still referring to FIG. 2A, ballistic resistant garment 10 in which said multiplicity of rows of stitches 54, 56 and another multiplicity of row of stitches 58, 60 of said panel 28 form a pattern of quilt stitches as shown in area that is circled and designated 80 in said panel 28 and in which said multiplicity of rows of stitches 44, 62 and another multiplicity of row of stitches 68, 72 of said another panel 30 form a pattern of box stitches as shown in area that is circled and designated 82.

A method for constructing a ballistic resistant garment 10 for covering and protecting vital portions of a human body having the steps of assembling at least two panels 28, 30 each having at least two layers of ballistic resistant material 34, 36 in which said ballistic material is woven 52 and stitching a plurality of stitches 42 into at least one panel 28 connecting said at least two layers of ballistic resistant material 34, 36 within said at least one panel 28 together and in which said plurality of stitches 42 are positioned away from the periphery of said at least one panel 28; and placing at least two of said at least two panels 28, 30 adjacent and overlying each other. A method for constructing a ballistic resistant garment 10, for covering and protecting vital portions of a human body, having the steps of assembling at least two panels 28 each having at least two layers of ballistic resistant material 34, 36 and stitching a plurality of stitches 42 first into a panel 28 connecting said at least two layers of ballistic resistant material 34, 36 within said panel 28 together and secondly into another panel 30 connecting said at least two layers of ballistic resistant material 34, 36 within said another panel 30 in which said plurality of stitches 42, 74 in each panel are positioned away from the periphery of each respective panel 28, 30.

While a detailed description of the preferred embodiment of the invention has been given, it should be appreciated that many variations can be made thereto without departing from the scope of the invention set forth in the appended claims.

I claim:

1. A ballistic resistant garment, for covering and protecting vital portions of a human body, comprising:

at least two panels which are adjacent and overlie one another in which each panel comprises at least two layers of ballistic resistant material in which said ballistic material is woven; and a plurality of stitches which are disposed into a first panel of said at least two panels connecting said at least two layers of ballistic resistant material within said first panel in which said plurality of stitches are positioned in a row in a first direction and another plurality of stitches which are disposed into a second panel of said at least two panels connecting said at least two layers of ballistic resistant material within said second panel, in which said another plurality of stitches are positioned in at least two rows, in which said at least two rows are in a second and third direction respectively, in which said second and third directions are transverse to one another and in which said row in said first direction of said first panel is transverse to said two rows in said second and third directions of said second panel in which said plurality and another plurality of stitches are positioned away from the periphery of said first and second panels.

2. The ballistic resistant garment of claim 1 in which said at least two panels are substantially enclosed within a sleeve member.

3. The ballistic resistant garment of claim 2 in which said sleeve member is composed of waterproof material.

4. The ballistic resistant garment of claim 1 in which said at least two panels are connected together with a means for securing said at least two panels together.

5. The ballistic resistant garment of claim 4 in which said securing means includes a multiplicity of stitches.

6. The ballistic resistant garment of claim 5 in which said multiplicity of stitches are composed of a high tensile strength material.

7. The ballistic resistant garment of claim 6 in which said high tensile strength material includes an aramid.

8. The ballistic resistant garment of claim 1 includes a soft core panel disposed between said at least two panels in which said soft core panel has dimensions less than the dimensions of said at least two panels.

9. The ballistic resistant garment of claim 8 in which said soft core panel includes at least two sheets of ballistic resistant material.

10. The ballistic resistant garment of claim 9 in which said at least two sheets of ballistic resistant material are composed of a high tensile strength material.

11. The ballistic resistant garment of claim 9 in which said at least two sheets of ballistic resistant material are composed of an aramid.

12. The ballistic resistant garment of claim 8 in which said soft core panel is secured to at least one of said at least two panels.

13. The ballistic resistant garment of claim 11 in which said soft core panel is secured with a further plurality of stitches to at least one of said at least two panels.

14. The ballistic resistant garment of claim 8 in which said soft core panel is positioned to overlie a sternum area of a wearer of said ballistic resistant garment.

15. The ballistic resistant garment of claim 8 in which said soft core panel is positioned to overlie a spinal cord area of a wearer of said ballistic resistant garment.

16. The ballistic resistant garment of claim 1 in which said at least two layers of ballistic resistant material of one of said at least two panels are composed of the same material.

17. The ballistic resistant garment of claim 1 in which said at least two layers of ballistic resistant material of all of said at least two panels are composed of the same material.

18. The ballistic resistant garment of claim 1 in which said at least two layers of ballistic resistant material is composed of a high tensile strength fibers.

19. The ballistic resistant garment of claim 17 in which said high tensile strength fibers is composed of an aramid.

20. The ballistic resistant garment of claim 1 in which each layer of said at least two layers of ballistic resistant material of one of said at least two panels are substantially the same shape.

21. The ballistic resistant garment of claim 1 in which each layer of said at least two layers of ballistic resistant material of one of said at least two panels are substantially the same length and width dimensions.

22. The ballistic resistant garment of claim 1 in which each layer of said at least two layers of ballistic resistant material of one of said at least two panels are substantially of the same thickness.

23. The ballistic resistant garment of claim 1 in which each of said at least two panels have a substantially equal number of said at least two layers of ballistic resistant material.

24. The ballistic resistant garment of claim 23 in which said fibers of said woven material are of a denier in a range from 50 to 3000.

25. The ballistic resistant garment of claim 23 in which said fibers of said woven material have a number of filaments in a range from 25 to 5000.

26. The ballistic resistant garment of claim 23 in which said fibers of said woven material are in a balanced weave.

27. The ballistic resistant garment of claim 23 in which said fibers of said woven material are in an imbalanced weave.

28. The ballistic resistant garment of claim 23 in which said woven material has said fibers in a warp to fill weave ratio in a range of 10 by 10 to 75 by 75.

29. The ballistic resistant garment of claim 23 in which said fibers of said woven material have a filament cross-overs per square inch in a range of 2,000,000 to 1,000,000,000.

30. The ballistic resistant garment of claim 23 in which said fibers of said woven material have a denier of 840 and a range of filaments of 560 to 1000.

31. The ballistic resistant garment of claim 29 in which said fibers of said woven material are in an imbalanced weave.

32. The ballistic resistant garment of claim 30 in which said weave has a warp to fill ratio of 24 by 22.

33. The ballistic resistant garment of claim 29 in which said fibers of said woven material have a micro-filament cross-overs per square inch in a range of 100,000,000 to 275,000,000.

34. The ballistic resistant garment of claim 1 in which the plurality of stitches is composed of a high tensile strength material.

35. The ballistic resistant garment of claim 34 in which said high tensile strength material is an aramid.

36. The ballistic resistant garment of claim 1 in which said plurality of stitches in said first panel includes at least one of another row of stitches positioned transverse to said row of stitches positioned in said first direction.

37. The ballistic resistant garment of claim 36 in which said plurality of stitches positioned in said row in said first direction in said first panel includes a plurality of said rows of stitches which are spaced apart from one another and substantially parallel to one another.

38. The ballistic resistant garment of claim 37 in which said plurality of stitches in said first panel includes said at least one of another row of stitches positioned transverse to said plurality of said rows which are spaced apart from one another and substantially parallel to one another.

39. The ballistic resistant garment of claim 38 in which said at least one of another row of stitches in said first panel includes a plurality of said another row of stitches in which said plurality of said rows and said plurality of said another row are transverse to each other and are positioned over a substantial portion of said first panel.

40. The ballistic resistant garment of claim 39 in which said plurality of said rows and said plurality of said another row are substantially perpendicular to one another.

41. The ballistic resistant garment of claim 40 in which said at least two rows of stitches disposed in said second panel includes a plurality of rows of stitches spaced apart from one another and substantially parallel to one another positioned in said second direction and a plurality of rows of stitches spaced apart from one another and substantially parallel to one another positioned in said third direction in which said plurality of rows of stitches in said second and third directions are positioned over a substantial portion of said second panel.

42. The ballistic resistant garment of claim of claim 41 in which said plurality of rows of stitches positioned in said second and third directions are substantially perpendicular to each other.

43. The ballistic resistant garment of claim 38 in which said plurality of rows of stitches disposed in said first panel in said first direction are positioned substantially parallel to the warp of said woven material.

44. The ballistic resistant garment of claim 38 in which said plurality of stitches disposed in said first panel are positioned substantially parallel to the warp of said woven material.

45. The ballistic resistant garment of claim 38 in which said at least one of another row of stitches are positioned substantially transverse to the warp of said woven material.

46. The ballistic resistant garment of claim 38 in which said plurality of rows of stitches positioned in the first direction in said first panel are substantially perpendicular to said warp.

47. The ballistic resistant garment of claim 38 in which said at least one of another row of stitches is transverse to said fill of said woven material.

48. The ballistic resistant garment of claim 47 in which said one of another row of stitches is substantially perpendicular to said fill.

49. The ballistic resistant garment of claim 1 in which said plurality of stitches disposed in said first panel includes a plurality of rows of stitches substantially parallel to one another and spaced apart from one another and aligned substantially in said first direction and has a plurality of another rows of stitches substantially parallel to one another and spaced apart from one another in which said plurality of another rows of stitches are positioned transverse to said plurality of rows of stitches positioned in said first direction, and in which said another plurality of stitches disposed in said second panel includes a plurality of rows of stitches substantially parallel to one another and spaced apart from one another and aligned substantially in said second direction and a plurality of rows of stitches substantially parallel to one another and spaced apart and aligned substantially in said third direction.

50. A ballistic resistant garment, for covering and protecting vital portions of a human body, comprising:

at least two panels which overlie one another in which each panel of said at least two panels comprises at least two layers of ballistic resistant material; and a plurality of stitches are disposed into a first panel of said at least two panels connecting said at least two layers of ballistic resistant material together within said first panel in which said plurality of stitches includes at least one row of stitches aligned in a first direction disposed in said first panel only and another plurality of stitches are disposed into a second panel of said at least two panels connecting said at least two layers of ballistic resistant material together within said second panel in which said another plurality of stitches includes at least two rows of stitches aligned in a second and third direction disposed in said second panel only in which said rows of stitches in said second and third rows are positioned transverse to one another and in which said row of stitches in said first direction in said first panel is transverse to said two rows in said second and third directions in said second panel.

51. The ballistic resistant garment of claim 50 in which said first panel and said second panel are adjacent to one another.

52. The ballistic resistant garment of claim 50 in which said ballistic resistant material is constructed of fibers which are woven.

53. The ballistic resistant garment of claim 52 in which the fibers are composed of a high tensile strength material.

54. The ballistic resistant garment of claim 52 in which the fibers of said woven material are of a denier in a range from 50 to 3000.

55. The ballistic resistant garment of claim 52 in which the fibers of said woven material have a number of filaments in a range from 25 to 5000.

56. The ballistic resistant garment of claim 52 in which the fibers of said woven material are in a balanced weave.

57. The ballistic resistant garment of claim 52 in which the fibers of said woven material are in an imbalanced weave.

58. The ballistic resistant garment of claim 52 the fibers of said woven material are in a warp to fill weave ratio in a range of 10 by 10 to 75 by 75.

59. The ballistic resistant garment of claim 52 in which said fibers of said woven material have a filament cross-overs per square inch in a range of 2,000,000 to 1,000,000,000.

60. The ballistic resistant garment of claim 50 in which said at least two panels are substantially enclosed within a sleeve.

61. The ballistic resistant garment of claim 50 includes a soft core panel constructed of a ballistic resistant material disposed between said first and second panels.

62. The ballistic resistant garment of claim 61 in which said soft core panel is positioned to overlie at least one of the sternum or spinal cord areas of a wearer of said ballistic resistant garment.

63. The ballistic resistant garment of claim 50 in which said ballistic resistant material for all of said at least two layers within one of said at least two panels are made of the same material.

64. The ballistic resistant garment of claim 63 in which said ballistic resistant material for all layers of said at least two layers within at least two of said at least two panels are all made of the same material.

65. The ballistic resistant garment of claim 50 in which at least two of said at least two panels have substantially equal thickness.

66. The ballistic resistant garment of claim 50 in which said plurality and another plurality of stitches are composed of a high tensile strength material.

67. The ballistic resistant garment of claim 50 in which said plurality of stitches disposed in said first panel includes a plurality of rows of stitches spaced apart and substantially parallel to one another in said first direction and a plurality of another rows of stitches spaced apart from one another and substantially parallel to one another in which said plurality of rows and said plurality of another rows are transverse to one another and in which said another plurality of stitches disposed in said second panel includes a plurality of rows of stitches spaced apart from one another and substantially parallel to one another positioned in said second direction and another plurality of rows of stitches spaced apart from one another and substantially parallel to one another positioned in said third direction in which said plurality and said another plurality of rows of stitches of said second panel are transverse to one another.

68. The ballistic resistant garment of claim 67 in which the transverse is substantially perpendicular.

69. The ballistic resistant garment of claim 67 in which said plurality and said another plurality of rows of stitches of said first panel each extend substantially across said first panel and in which said plurality of and said another plurality of rows of stitches of said second panel each extend substantially across said second panel.

70. The ballistic resistant garment of claim 67 in which said plurality of and said another plurality of rows of stitches of said first panel form a pattern of quilt stitches in said first panel and in which said plurality of and another plurality of rows of stitches of said second panel form a pattern of box stitches.

71. A method for constructing a ballistic resistant garment, for covering and protecting vital portions of a human body, comprising the steps of:

assembling at least two panels each panel having at least two layers of ballistic resistant material within each panel and in which said ballistic material is woven;

stitching a plurality of stitches into a first panel of said at least two panels in which said plurality of stitches includes at least one row of stitches positioned in a first direction connecting said at least two layers of ballistic resistant material within said first panel together and in which said plurality of stitches are positioned away from the periphery of said first panel;

stitching another plurality of stitches into a second panel of said at least two panels in which said another plurality of stitches includes at least two rows of stitches positioned in a second and third directions connecting said at least two layers of ballistic resistant material together within said panel and in which said another plurality of stitches are positioned away from the periphery of said second panel in which said at least two rows of stitches in said second and third directions are positioned transverse to one another and in which said at least one row of stitches positioned in said first direction in said first panel is positioned transverse to said at least two rows of stitches in said second and third directions; and placing said first and second panels of said at least two panels in overlying relationship and adjacent to one another.

72. A method for constructing a ballistic resistant garment, for covering and protecting vital portions of a human body, comprising the steps of:

assembling at least two panels to overlie one another in which each panel has at least two layers of ballistic resistant material;

stitching a plurality of stitches into a first panel of said at least two panels connecting said at least two layers of ballistic resistant material within said first panel of said at least two panels together in which said plurality of stitches includes at least one row of stitches positioned in a first direction in said first panel only; and stitching another plurality of stitches into a second panel of said at least two panels connecting said at least two layers of ballistic resistant material within said second panel of said at least two panels in which said another plurality of stitches includes at least two rows of stitches positioned in a second and third direction in said second panel only, in which said at least two rows of stitches are positioned transverse to one another and in which said row of stitches positioned in said first direction in said first panel are transverse to said at least two rows of stitches positioned in said second panel in said second and third directions.

73. A ballistic resistant garment, for covering and protecting vital portions of a human body, comprising:

at least two panels which are adjacent and overlie one another in which each panel comprises at least two layers of ballistic resistant material in which said ballistic material is woven and in which a soft core panel is disposed between said at least two panels and in which said soft core panel has dimensions less than the dimensions of said at least two panels; and a plurality of stitches are disposed into a first panel of said at least two panels connecting said at least two layers of ballistic resistant material together within said first panel in which said plurality of stitches are positioned in a first row in which the first row is positioned in a first direction and another plurality of stitches are disposed into a second panel of said at least two panels connecting said at least two layers of ballistic resistant material together within said second panel in which said another plurality of stitches are positioned into a plurality of rows of stitches in which a second and third row of stitches are positioned in a second and third direction respectively and are positioned transverse to one another and in which said first row of stitches of said first panel is positioned transverse to said second and third row of stitches of said second panel and in which said plurality and another plurality of stitches are positioned away from the periphery of said first and second panels respectively.

74. The ballistic resistant garment of claim 73 in which said soft core panel includes at least two sheets of ballistic resistant material.

75. The ballistic resistant garment of claim 74 in which said at least two sheets of ballistic resistant material are constructed of a high tensile strength material.

76. The ballistic resistant garment of claim 75 in which said at least two sheets of ballistic resistant material are constructed of an aramid.

77. The ballistic resistant garment of claim 73 in which said soft core panel is secured to at least one of said at least two panels.

78. The ballistic resistant garment of claim 77 in which said soft core panel is secured with a further plurality of stitches to at least one of said at least two panels.

79. The ballistic resistant garment of claim 41 in which said plurality of rows of stitches disposed in said second panel in said second direction are positioned substantially parallel to the warp of said woven material.

80. The ballistic resistant garment of claim 41 in which said plurality of rows of stitches disposed in said second panel in said third direction are substantially parallel to the warp of said woven material.

81. The ballistic resistant garment of claim 41 in which said plurality of rows of stitches disposed in said second panel in said third direction are positioned substantially transverse to the warp of said woven material.

82. The ballistic resistant garment of claim 41 in which said plurality of rows of stitches disposed in said second panel in said second direction are substantially transverse to said warp.

83. The ballistic resistant garment of claim 41 in which said plurality of row of stitches disposed in said second panel in said second direction is transverse to said fill of said woven material.

84. The ballistic resistant garment of claim 41 in which said plurality of rows of stitches disposed in said second panel in said second direction are substantially perpendicular to said fill.

* * * * *

UNITED STATES PATENT AND TRADEMARK OFFICE

CERTIFICATE OF CORRECTION

PATENT NO. : 5,479,659
DATED : January 2, 1996
INVENTOR(S) : Bachner, Jr.

It is certified that error appears in the above-identified patent and that said Letters Patent is hereby corrected as shown below:

Title page,
Item [57], ABSTRACT,
Line 16, before ", in which" delete "62)" and insert -- 68) --;
Line 17, before "are in" delete "62)" and insert -- 68) --; and after "third direction" delete "(44, 62)".
Line 18, after "and third direction" delete "(44, 62)".
Line 20, after "direction" delete "(54)".
Line 21, after "rows" change "(44, 62)" to -- (44, 68) --; and after "and third direction" delete "(44, 62)".

Drawings,
Sheet 2, Fig. 2A, on the left side, change reference number "38" to -- 35 -- (as shown below); and change lead line on reference number "44" to contact a somewhat vertical line of stitches parallel to stitches marked "62" rather than it contacting a rather horizontal line of stitches (as shown below).

Fig. 2A

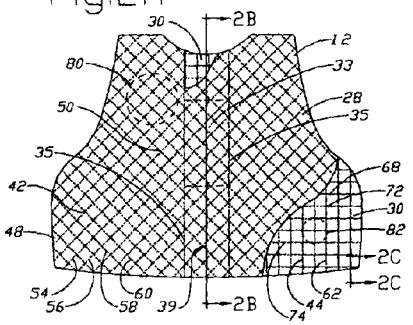

Fig. 2B, change reference number "39" at the top of Fig. 2B to -- 38 -- (as shown below); and at the bottom of Fig. 2B, the second and fourth reference number "74", counting from the left, change to reference number -- 37 -- (as shown below).

Fig. 2B

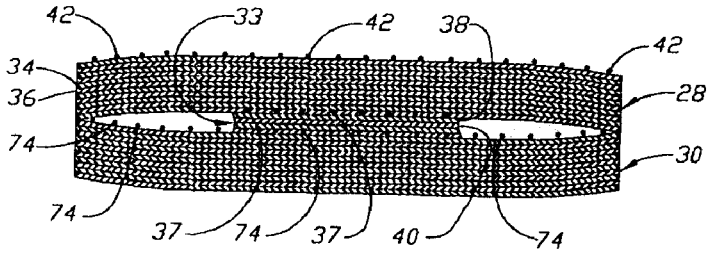

UNITED STATES PATENT AND TRADEMARK OFFICE

CERTIFICATE OF CORRECTION

PATENT NO. : 5,479,659
DATED : January 2, 1996
INVENTOR(S) : Bachner, Jr.

It is certified that error appears in the above-identified patent and that said Letters Patent is hereby corrected as shown below:

Drawings (cont'd),
Sheet 3, Fig. 2C, at the left side, change reference number "28" to -- 30 -- (as shown below); and change reference number "42", (all occurrences), to -- 74 -- (as shown below).

Fig. 2C

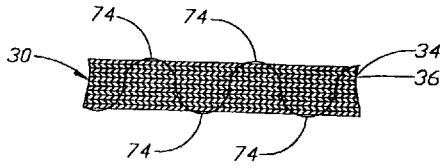

Sheet 4, Fig. 3, change reference number "54" to -- 53 -- (as shown below); and Fig. 4, change reference number "56" to -- 55 -- (as shown below).

Fig. 3

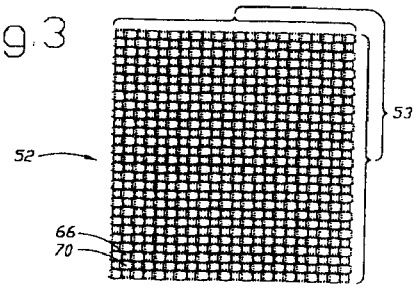

Fig. 4

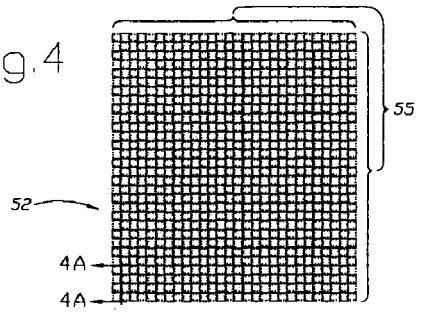

Column 1,
Line 63, after "a balanced" delete "palin" and insert -- plain --.

Column 4,
Line 61, after "rip stop" delete "paffeta" and insert -- taffeta --.

Column 5,
Line 32, after "FIG." delete "2B" and insert -- 2A --.
Lines 47 and 48, after "Soft core panel" delete "36" and insert -- 33 --.
Lines 50 and 53, after "of stitches" delete "38" and insert -- 37 --.
Line 59, after "core panel" delete "36" and insert -- 33 --.
Lines 64 and 65, after "resistant material" delete "39," and insert -- 38, --.
Line 67, after "soft core panel" delete "36" and insert -- 33 --.

UNITED STATES PATENT AND TRADEMARK OFFICE

CERTIFICATE OF CORRECTION

PATENT NO. : 5,479,659
DATED : January 2, 1996
INVENTOR(S) : Bachner, Jr.

It is certified that error appears in the above-identified patent and that said Letters Patent is hereby corrected as shown below:

Column 6,
Line 2, after "resistant material" delete "39," and insert -- 38, --.
Line 6, after "2A and" delete "2C" and insert -- 2B --.
Lines 16 and 26, after "FIGS." delete "2B and 2C" and insert -- 2A and 2B --.
Line 45, after "balanced weave" delete "54" and insert -- 53 --.
Line 48, after "unbalanced weave" delete "56" and insert -- 55 --.

Column 7,
Lines 10 and 48, after "of stitches" delete "42" and insert -- 74 --.
Line 11, after "disposed into" delete "at least one panel 28" and insert -- second panel 30 --.
Lines 12-13, after "34, 36 within" delete "at least one panel 28" and insert -- second panel 30 --.
Line 49, after "positioned" delete "transverse" and insert -- parallel --.
Line 50, after "ballistic material 34, 36" insert -- in panel 30 --.
Lines 55 and 60 after "stitches" delete "42" and insert -- 74 --.
Line 63, after "woven material delete "74" and insert -- 52 --; and after "of stitches" delete "52" and insert -- 74 --.

Column 8,
Lines 18, 22 and 28, after "of stitches" delete "24" and insert -- 42 --.
Line 54, after "stitches" delete "42" and insert -- 74 --.

Signed and Sealed this

Sixth Day of May, 2003

JAMES E. ROGAN
*Director of the United States Patent and Trademark Office*